United States Patent [19]

Miura et al.

[11] Patent Number: 4,856,313

[45] Date of Patent: Aug. 15, 1989

[54] METHOD OF CONTROLLING STRIP CROWN IN PLANETARY ROLLING

[75] Inventors: Ryozo Miura; Yoshio Okamoto; Hiroki Takahashi, all of Yokohama; Souichi Inada, Yokosuka, all of Japan

[73] Assignee: Nippon Yakin Kogyo Co., Ltd., Tokyo, Japan

[21] Appl. No.: 97,199

[22] Filed: Sep. 16, 1987

[51] Int. Cl.[4] ..... B21B 1/02; B21B 1/22; B21B 1/42

[52] U.S. Cl. ..... 72/234; 29/122; 72/197; 72/199; 72/240

[58] Field of Search ..... 72/240, 197, 190, 199, 72/366, 234, 241, 247; 29/122

[56] References Cited

U.S. PATENT DOCUMENTS

| | | | |
|---|---|---|---|
| 3,533,260 | 10/1970 | Marcovitch | 72/190 |
| 3,789,646 | 2/1974 | Sendzimir | 72/241 X |
| 4,730,475 | 3/1988 | Ginzburg | 72/234 |

FOREIGN PATENT DOCUMENTS

| | | | |
|---|---|---|---|
| 0164265 | 12/1985 | European Pat. Off. | 72/234 |
| 49-139488 | 6/1976 | Japan . | |
| 0209409 | 11/1984 | Japan | 72/199 |
| 0235005 | 10/1986 | Japan | 72/247 |

OTHER PUBLICATIONS

Japanese Technical Magazine, Journal of the Japanese Society of the Technology of Plasticity, vol. 22, No. 247, 1981-8, pp. 839-846.

*Primary Examiner*—Robert L. Spruill
*Assistant Examiner*—Steven B. Katz
*Attorney, Agent, or Firm*—Balogh, Osann, Kramer, Dvorak, Genova & Traub

[57] ABSTRACT

Method of controlling a strip crown in a planetary mill line, comprising the steps of rolling a slab by using a shaped feeding roll or rolls before passing between planetary rolls to shape a slab profile in the direction of the width of the slab having a flat or curved central portion, opposite side end thicker than the central portion and side portions thinner than the central portion between the central portion and the opposite side ends and subsequently rolling the slab having such a shaped slab providing a planetary rolled strip having a substantially flat strip crown having a uniform thickness over the width of the strip.

5 Claims, 4 Drawing Sheets

METHOD OF CONTROLLING STRIP CROWN IN PLANETARY ROLLING

BACKGROUND OF THE INVENTION

The present invention relates to a method of controlling strip crown in planetary rolling of metallic material on a planetary mill for improving strip crown of planetary-rolled strips by preventing the occurrence of edge-drop and high spot of the strip crown.

In hot rolling of a strip, there has been used a rolling mill such as a tandem mill, a steckel mill, a planetary mill or the like. The hot strip manufactured by such a rolling mill always has a thickness deviation along the width of the strip which is referred to as a strip crown. The strip crown is classified into a center crown formed by slightly increasing the thickness in the central region of the strip and an edge drop formed by sharply decreasing the thickness in the edge region of the strip. In order to improve the strip crown, in the tandem mill, there have been known some methods such as a method using roll benders for work rolls and backup rolls in finishing the roll stands, a method using a six roll mill referred to as a HC mill and a method using tapered rolls. It has been understood from studies about the tandem rolling that the final strip crown is affected by only the last stand of the finishing roll stands rather than by the forward stands. In view of such an understanding, the last two or three stands of the finishing roll stands in the tandem mill have been modified to provide a shape control function and resulted in substantial effects.

The planetary mill comprises a pair of backup rolls having a large diameter and a plurality of planetary rolls having a small diameter arranged around each of the backup rolls. A slab is rolled by one to three sets of feeding rolls and then rolled by the planetary rolls. The slab is subjected to a small reduction several times by the planetary rolls, resulting thereby in a large total reduction of more than 90% by the planetary mill. Therefore, the planetary mill performs the function of the latter half of roughing roll stands and the finishing roll stands of the tandem mill.

The planetary mill is subjected to a very small roll separating force in spite of a large total reduction and the center crown of the planetary-rolled strip is very small owing to the backup rolls of the large diameter and the total crown depends on the edge drop.

The conventional feeding rolls used on the planetary mill line have straight crowns (FIG. 6) or curved crowns defined by a quadratic curve for correction of elastic deformation of the rolls or convex crown defined by a sine curve (FIG. 7).

The characteristic of the crown of the planetary mill is described, for example, in "Journal of the Japanese Society of the Technology of Plasticity" Vol 22, No, 247, 1981-8, P 839-846 "the shape and characteristic of planetary-rolled strip". There is described that the strip crown is affected by many factors. Furthermore, Japanese Patent Application laid open Publication No. 51-66263 discloses a planetary mill of crown controllable type comprising double groups of planetary rolls arranged around the backup rolls, the roll crown of which is adjustable.

The aforementioned "Journal of the Japanese Society of Technology Plasticity" does not disclose any teaching for improving the strip crown. The arrangement of the rolling mill described in Japanese Patent Application laid open Publication No. 51-66263 can not be adapted for the Sendzimir type planetary mill having single group of planetary rolls. Moreover, when the arrangement of the rolling mill is adapted to the existing planetary mill having double groups of planetary rolls, it is necessary to modify on a large scale and such modification is practically difficult.

When rolling the slab by the planetary mill, the thickness of the rolled strip having for example five feet width, sometimes locally increases in a region width 50-150 mm from the edge of the strip. It is called a high spot. This phenomenon occurs when a slab having a flat crown, after leaving the feeding rolls, is fed to the planetary rolls. The cause of such a phenomenon has not been made entirely clear. It is conjuctured that the phenomenon is caused by bending of comparatively slender planetary rolls, but the cause is still unclear. In planetary rolling, when the thickness of the center of the rolled strip is increased, the rolled strip shows center buckling. And when the thickness of the rolled strip is locally increased, the rolled strip tends to show guarter buckling.

Such a phenomenon is entirely contrary to the usual rolling wherein a thinner portion is elongated and shows buckling.

When the planetary-rolled strip having the local thickness deviation along the width thereof is rerolled, a complex localized elongation of the strip occurs and such a localized elongation could not be sufficiently corrected by the profile control technique so that the locally elongated strip is not used as a rerolling material.

As aforementioned, the conventional method of rolling on the planetary mill line has a problem such that the edge drop of the strip crown could not be decreased and the local increase of the thickness, i.e. high spot, could not be prevented.

SUMMARY OF THE INVENTION

The object of the present invention is to decrease the edge drop and to prevent the local increase of the thickness of planetary-rolled strip.

For the above object, the present invention provides a method of controlling the strip crown in planetary rolling on a planetary mill line comprising edger rolls, feeding rolls, planetary rolls and planishing rolls, which method is characterized in that the feeding roll adjacent to the planetary rolls has a roll crown such that the central region is flat or slightly curved for correcting a bend of the feeding roll and has a diameter, at each side portion spaced from each of both side ends of the effective rolling width of the feeding rolls by a distance determined by a roll gap between the central regions of a pair of feeding rolls, which is larger than a diameter at the central region of the feeding rolls by 0.1-1% and further the side region between the side portions having the increased diameter and the side end of the effective rolling width is tapered to provide a smaller diameter at the side ends than the diameter of the central region, thereby to provide a planetary-rolled strip having a substantially flat strip crown.

BRIEF DESCRIPTION OF THE DRAWINGS

Further objects and advantages of the present invention will become apparent as the following description of the illustrated embodiments proceeds with reference to the drawings in which.

DETAILED EXPLANATION OF THE PREFERRED EMBODIMENTS

The inventors made tests and studied the behavior of rolling in a planetary mill and found that the strip crown of a planetary rolled strip is largely depended on the three dimensional deformations of the slab and is substantially determined by a combination of the distribution of spreading in the direction of width of the slab and the distribution of elongation in the longitudinal direction of the slab. It was also found from the result of the test that in rolling on the conventional planetary mill line according to the prior art, the edge drop-in problem occurs at a portion of insufficient volume of the slab material in the edge region and also the locally increasing of thickness in problem occurs at a portion of excessive volume of the slab material.

Figure 1:
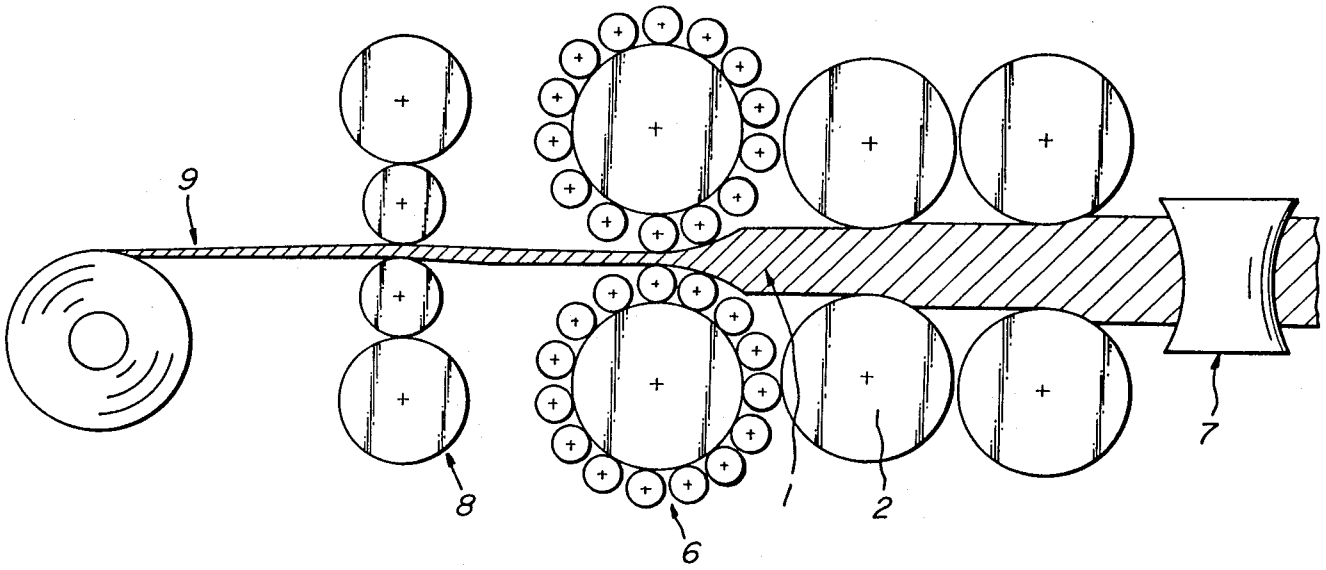
FIG. 1 is a schematic sectional view of an embodiment of a planetary mill line.
Figure 2:
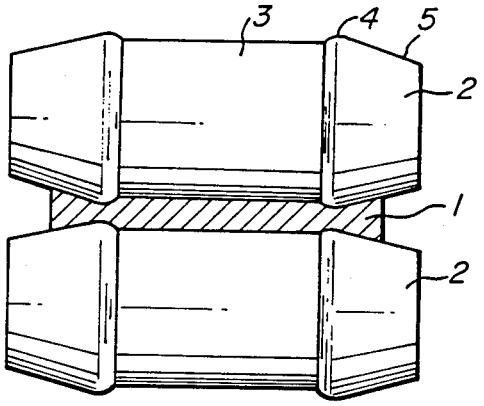
FIGS. 2 to 5 are schematic views of various embodiments of feeding rolls used in the present invention.
Figure 3:
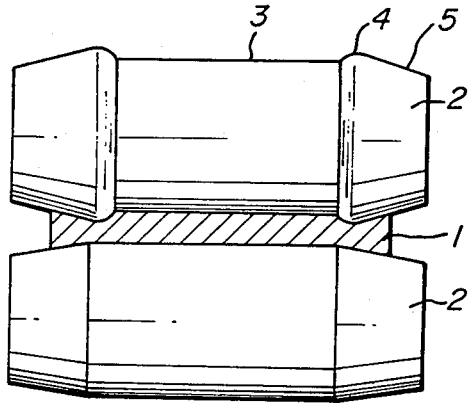
Figure 4:
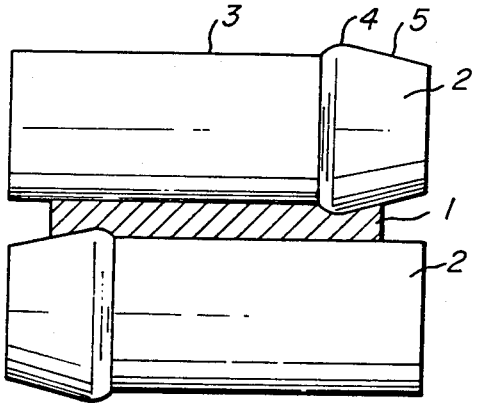

In view of the above recognition, the inventors made a rolling test on the planetary mill line by using feeding rolls 2 as shown in FIG. 2. The feeding rolls 2 has a roll crown such that the central region 3 is flat or is slightly curved for correcting a bend of the feeding roll and a diameter at side portion 4 spaced from the side end of the effective rolling width of the feeding roll by a distance determined by a roll gap between the central regions 3,3 of a pair of feeding rolls 2,2 is larger than a diameter of the central region of the feeding rolls by 0.1–1% of the diameter thereof to form an enlarged portion 4. Furthermore, the side region 5 between the side enlarged portion 4 and the side end is tapered by a taper angle from the enlarged portion 4 towards the side end. From the result of the test using the aforementioned feeding rolls, it was found that the strip crown can be made flat by planetary rolling after the feeding rolls. The diameter of the side enlarged portion 4 and the taper angle of the tapered side region 5 are critical in order to obtain a satisfactory flatness of the strip crown. Since the rolling condition is usualy standardized, it is easy to select the correct diameter of the enlarged side portion 4 and the taper angle of th tapered side region 5. For example, when a slab having a width of 1500 mm and a thickness of 83 mm is planetary rolled, it is most preferable that the feeding roll is formed with the enlarged side portion 4 at a position spaced from the side end of the effective rolling width by a distance of 100 mm and is tapered from the enlarged side portion 4 towards the side end. When the thickness of the slab to be planetary rolled is 55 mm, it is most preferable that the diameter of the feeding roll is decreased from a position spaced from the side end of the effective rolling width by a distance of 80 mm. FIG. 3 shows another embodiment of a pair of the feeding rolls 2 only one of which has the enlarged side portion 4 at the position spaced from the side end and the tapered side region 5 and the other feeding roll 2 has not the enlarged side portion, but this embodiment can provide a similar result. FIG. 4 also shows another embodiment of a pair of the feeding rolls 2 having the enlarged side portion 4 and the tapered side reagion 5 at only one side thereof, but this embodiment can also provide a similar result.

EXAMPLE

Slabs of stainless steel SUS 304, which is 18-8 type stainless steel, are hot rolled on the planetary mill line according to the method of the present invention.

Figure 6:
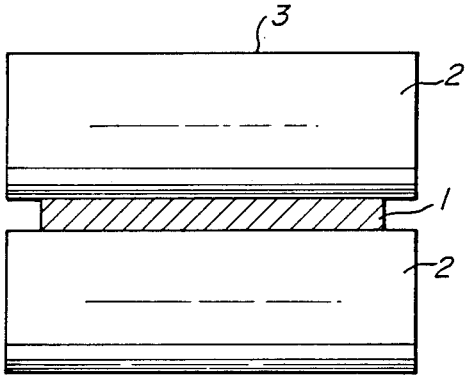
FIG 6 Prior Art
FIGS. 6 and 7 are schematic views of conventional feeding rolls.
Figure 7:
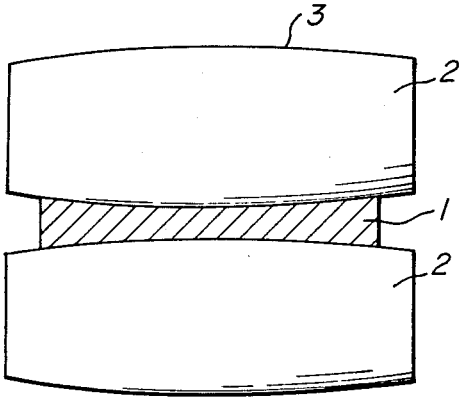
FIG 7 Prior Art

FIG. 8 shows the crown profile of slabs having a width of 1050 mm after being shaped by the feeding rolls according to the method of the present invention and the conventional rolling method. FIGS. 8*a* and 8*b* show the slab profiles after being shaped by the feeding rolls according to the conventional method. FIG. 8*a* shows the crown profile of the slab rolled by the feeding rolls having the straight crown as shown in FIG. 6. FIG. 8*b* shows the crown profile of the slab rolled by the feeding rolls having the curved crown defined by the quadratic curve or convex crown defined by a sine curve as shown in FIG. 7 and the slab has thickness of 83 mm at the width center and thickness of 85 mm at the side end portions of the effective rolling width.

Figure 5:
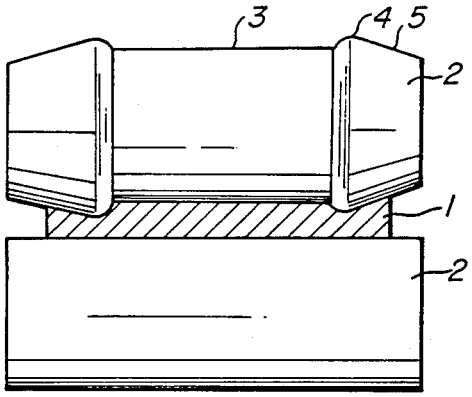
Figure 8A:
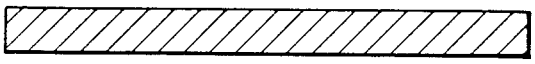
FIG 8a Prior Art
FIGS. 8*a* and 8*b* show various slab profiles formed by feeding rolls according to the conventional method.
Figure 8B:
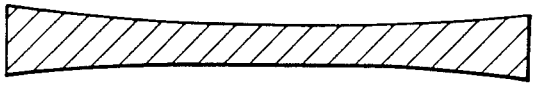
FIG 8b Prior Art
Figure 8C:
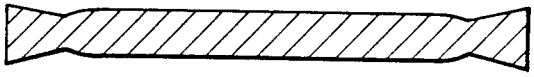
FIGS. 8*c* to 8*f* show various slab profiles formed by feeding rolls according to the present invention.
Figure 8D:
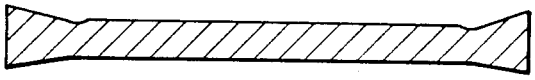
Figure 8E:
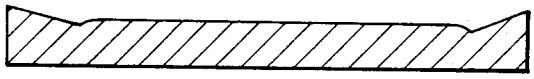
Figure 8F:
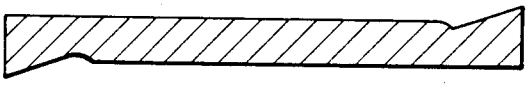

FIGS. 8*c*, 8*d*, 8*e*, 8*f* show the slab profiles achieved according to the method of the present invention. FIG. 8*c* shows the crown profile of the slab rolled by the feeding rolls having the roll crown profile shown in FIG. 2 and the slab has a thickness of 83 mm at the width center, a thickness of 78 mm at the thin portion formed by the enlarged side portions of the upper and the lower feeding rolls and a thickness of 85 mm at the side ends of the effective rolling width. The position of the thin portion in the width direction of the thicker slab is nearer to the width center than the thinner slab. FIG. 8*d* shows the crown profile of the slab rolled by the feeding rolls having the roll crown profile shown in FIG. 3 and the slab has a thickness of 83 mm at the width center, a thickness of 78 mm at the thin portions and a thickness of 85 mm at the side ends of the effective rolling width. FIG. 8*e* shows the crown profile of the slab rolled by the feeding rolls having the roll crown profile shown in FIG. 5, one of which feeding rolls has the roll crown the same as that of FIG. 2 and the other has the straight crown and the slab has a thickness of 83 mm at the width center, a thickness of 78 mm at the thin positions and a thickness of 85 mm at the side ends of the effective rolling width. FIG. 8*f* shows the crown profile of the slab rolled by the feeding rolls having the roll crown profile shown in FIG. 4 and the slab has a thickness of 83 mm at the width center, a thickness of 78 mm at the thin portions and a thickness of 85 mm at the side ends of the effective rolling width of the tapered side region.

Figure 9:
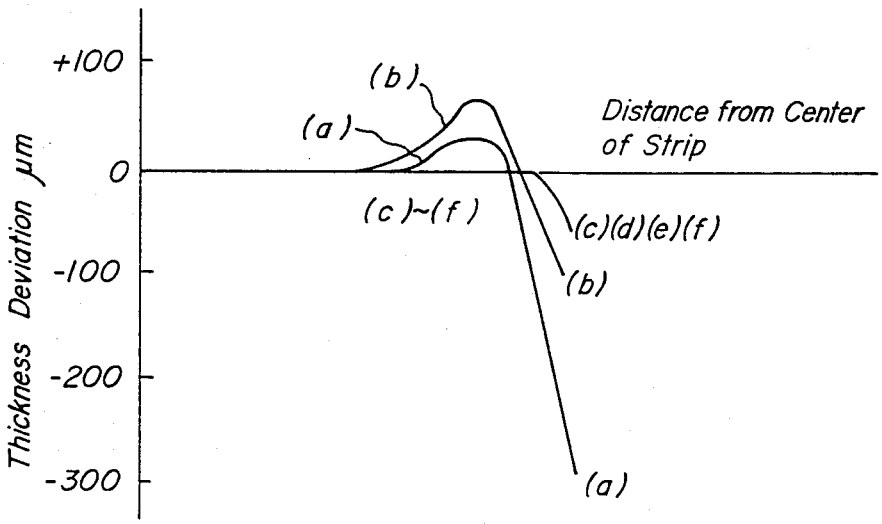
FIG. 9 is a diagram showing the thickness deviations in the direction of width of strips after the slabs shown in FIG. 8 are rolled by planetary rolls.

FIG. 9 shows relations between distance from the center of strip and the thickness deviation of the strip crown of planetary-rolled strips of the slabs shown in FIGS. 8*a*, 8*b*, 8*c*, 8*d*, 8*e*, and 8*f*. It is seen from FIG. 9 that the planetary-rolled strips according to the conventional method using the slabs having the straight crown and the sine courved crown shown in FIGS. 8*a*, and 8*b* have large edge drops and a locally increased thickness as shown in FIGS. 9*a*, and 9*b*. On the contrary, the planetary-rolled strips according to the present invention using the feeding rolled slabs having crown profile shown in FIGS. 8*c*, 8*d*, 8*e*, and 8*f* have a small edge drop and a flat crown shape without increased thickness as shown in FIG. *9c, 9d, 9e,* and *9f* shown in FIGS. *9a,* and *9b.*

The present invention can also be applied to not only a Sendzimir type planetary mill, but also to a Krupp-Platzer type planetary mill having double groups of planetary rolls.

The present invention can also be applied to a Roll Cast type planetary mill, double three high mills, pendulum mills, DSW mills and others of same rolling mechanism as that of the planetary mill.

According to the present invention, it is possible to obtain a planetary-rolled strip having a flat profile with a limited edge drop and a local thickness variation and to provide high grade strips usable for cold rolling materials as well as hot rolled products. The present invention is also carried out by preparing the feeding rolls having the desired crown profile shaped by machining with low investment.

What is claimed is:

1. A method of controlling strip crown in a planetary mill line including feeding rolls and planetary rolls, comprising the steps of rolling a slab with feeding rolls to shape a slab profile in the direction of the width of the slab having a flat or curved central portion, opposite side ends being thicker than the central portion and side portions being thinner than the central portion between the cemntral portion and the opposite side ends, at least one of a pair of the feeding rolls including a flat or curved central region, at least one reduced side end having a diameter smaller than that of the central region, at least one enlarged side portion being spaced from the reduced side end by a distance determined by a roll gap between the central regions of the pair of feeding rolls and having a diameter 0.1–1% larger than that of the central region and a tapered side region between the enlarged side portion and the reduced end, and substantially rolling the slab having the shaped slab profile by means of planetary rolls, thereby providing a planetary rolled strip having a substantially flat strip crown having a uniform thickness over the width of the strip.

2. A method as claimed in claim 1, wherein both of the pair of feeding rolls having the roll crown.

3. A method as claimed in claim 1, wherein the other of the pair of feeding rolls has a curved crown with tapered end portion.

4. A method as claimed in claim 1, wherein each of the feeding rolls has the enlarged side portion having the increased diameter at only one side region.

5. A method claimed in claim 1, wherein the other of the pair of feeding rolls has a straight crown.

* * * * *